US005477053A

United States Patent [19]

Umemoto et al.

[11] Patent Number: 5,477,053

[45] Date of Patent: Dec. 19, 1995

[54] RADIOGRAPHIC INTENSIFYING SCREEN AND PROCESS FOR PREPARING THE SAME

[75] Inventors: Akio Umemoto, Kanagawa; Yujiro Suzuki, Odawara; Tutomu Watanabe, Odawara; Michio Tanaka, Fujisawa; Nobuaki Koike, Chigasaki, all of Japan

[73] Assignee: Kasei Optonix, Ltd., Tokyo, Japan

[21] Appl. No.: 254,769

[22] Filed: Jun. 6, 1994

[30] Foreign Application Priority Data

Jun. 10, 1993 [JP] Japan ..... 5-165137
Apr. 14, 1994 [JP] Japan ..... 6-075659

[51] Int. Cl.[6] ..... G21K 4/00
[52] U.S. Cl. ..... 250/483.1
[58] Field of Search ..... 250/483.1

[56] References Cited

U.S. PATENT DOCUMENTS 3,164,719 1/1965 Bauer ..... 250/488.1
4,689,277 8/1987 Minagawa et al. ..... 250/483.1
4,772,803 9/1988 Horiuchi et al. ..... 250/487.1
4,979,200 12/1990 Umemoto et al. ..... 250/483.1

FOREIGN PATENT DOCUMENTS 97377 1/1984 European Pat. Off. ..... 250/4831

*Primary Examiner*—Carolyn E. Fields
*Attorney, Agent, or Firm*—Oblon, Spivak, McClelland, Maier, & Neustadt

[57] ABSTRACT

This invention relates to a radiographic intensifying screen excellent in sharpness and durability, which comprises a support, a fluorescent layer formed on the support, and a protective layer formed by coating a solution containing a protective layer-forming resin on the fluorescent layer, wherein a water repellent layer or a resin layer which may optionally contain a water repellent is provided between the fluorescent layer and the protective layer, or the fluorescent layer may optionally contain a water repellent, and also relates to a process for preparing the same.

19 Claims, 1 Drawing Sheet

RADIOGRAPHIC INTENSIFYING SCREEN AND PROCESS FOR PREPARING THE SAME

BACKGROUND OF THE INVENTION

1. Field of the Invention

The present invention relates to a radiographic intensifying screen (hereinafter referred to simply as an "intensifying screen"). More particularly, the present invention relates an intensifying screen excellent in sharpness and durability, which has a protective layer formed by coating a solution containing a protective layer-forming resin.

2. Discussion of Background

An intensifying screen is used in intimate contact with an X-ray photographic film in order to improve sensitivity of photographing in the field of medical radiography for medical diagnosis or of industrial radiography for non-destructive inspection of materials.

Particularly, in the radiographic diagnosis, it is strongly demanded for accurate diagnosis to improve sharpness of an intensifying screen. Thus, it is studied to improve image quality of an intensifying screen, for example, by reducing a binder resin amount in a fluorescent layer. However, in the case of forming a protective layer by coating a solution containing a protective layer-forming resin (hereinafter referred to as a "protective layer coating solution") on the surface of a fluorescent layer, if the binder resin amount is small in the fluorescent layer, it has been difficult to obtain an intensifying screen having a satisfactory protective layer excellent in durability and uniform film properties, due to such problems as that a protective layer coating solution penetrates into the fluorescent layer during coating and that bubbles are sometimes generated in the fluorescent layer. On the other hand, a large amount of a protective layer coating solution is coated by considering the penetration of the protective layer coating solution into the fluorescent layer, there has been a problem of degrading sharpness of the intensifying screen. Thus, in the intensifying screen having a protective layer formed by coating a protective layer-forming solution, it has been difficult to improve durability and sharpness at the same time by maintaining the binder resin amount in the fluorescent layer sufficiently small.

An object of the present invention is to provide an intensifying screen having improved sharpness and satisfactory durability and a process for preparing the same, which comprises forming a protective layer by coating a protective layer coating solution on the surface of the intensifying screen while maintaining the binder resin amount in the fluorescent layer sufficiently small and preventing the protective layer coating solution from penetrating into the fluorescent layer.

In order to image quality properties of an intensifying screen, the present inventors have variously studied to overcome the above-mentioned problems of the penetration of the protective layer coating solution into the fluorescent layer and the generation of bubbles in the fluorescent layer when the binder resin amount in the fluorescent layer is reduced. As the results of this study, it has been discovered that an intensifying screen having excellent sharpness and durability can be obtained without penetration of a protective layer coating solution into a fluorescent layer or without generation of bubbles in a fluorescent layer in the case of forming a protective layer on the fluorescent layer with a reduced binder amount, (i) by providing a water repellent layer on the fluorescent layer and then coating a protective layer coating solution thereon, (ii) by providing a fluorescent layer containing a water repellent and then coating a protective layer coating solution on the fluorescent layer, or (iii) by coating a small amount of a solution containing a resin and an organic solvent (hereinafter referred to as a "resin solution") on a fluorescent layer to provide a resin layer thinner than a protective layer and then coating a protective layer on the resin layer.

SUMMARY OF THE INVENTION

The present invention relates to a radiographic intensifying screen which comprises a support, a fluorescent layer formed on the support, and a protective layer formed by coating a solution containing a protective layer-forming resin on the fluorescent layer, characterized in that a water repellent layer is provided between the fluorescent layer and the protective layer, or that the fluorescent layer contains a water repellent.

The present invention further relates to a radiographic intensifying screen which comprises a support, a fluorescent layer formed on the support, and a protective layer formed by coating a solution containing a protective layer-forming resin on the fluorescent layer, characterized in that a resin layer is provided by coating by a resin solution between the fluorescent layer and the protective layer.

The present invention still further relates to a process for preparing a radiographic intensifying screen, which comprises coating a solution containing a water repellent on a fluorescent layer previously formed, drying, further coating a solution containing a protective layer-forming resin thereon, and drying.

The present invention still further relates to a process for preparing a radiographic intensifying screen, which comprises coating a phosphor coating solution containing a water repellent on a support, drying, further coating a solution containing a protective layer-forming resin thereon, and drying.

The present invention still further relates to a process for preparing a radiographic intensifying screen, which comprises coating a resin solution containing a resin and an organic solvent on a fluorescent layer previously formed, drying to form a resin layer, further coating a solution containing a protective layer-forming resin thereon, and drying to form a protective layer.

DETAILED DESCRIPTION OF THE INVENTION

Figure 1:
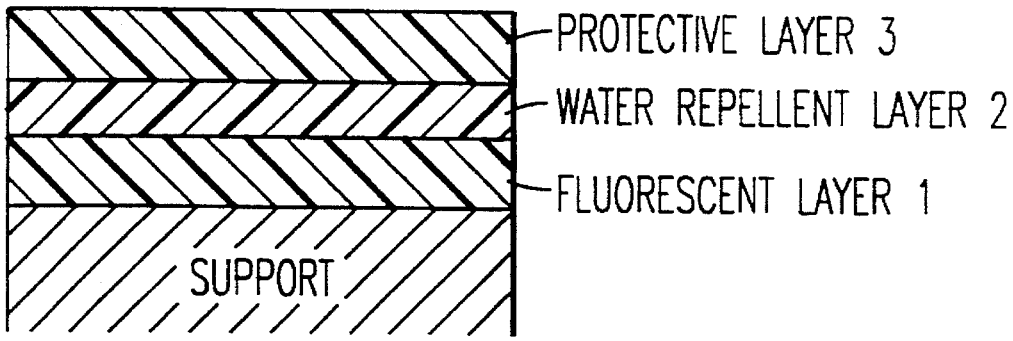
FIG. 1 shows the embodiment wherein a separate water repellent layer has been formed between the fluorescent layer and the protective layer. The fluorescent layer is represented by 1. The water repellent layer is represented by 2. The protective layer is represented by 3.
Figure 2:
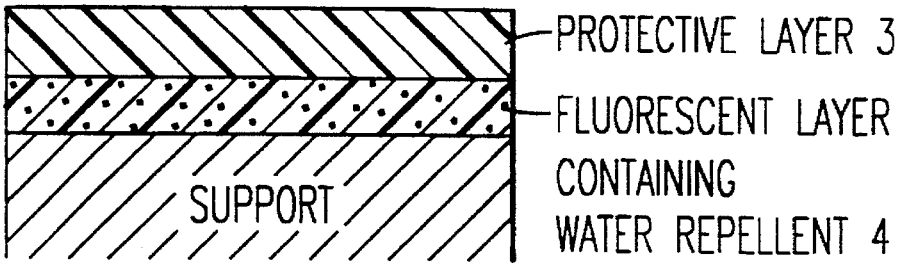
FIG. 2 shows the embodiment wherein the fluorescent layer contains a water repellant. The fluorescent layer containing water repellent therein is represented by 4. The protective layer is represented by 3.
Figure 3:
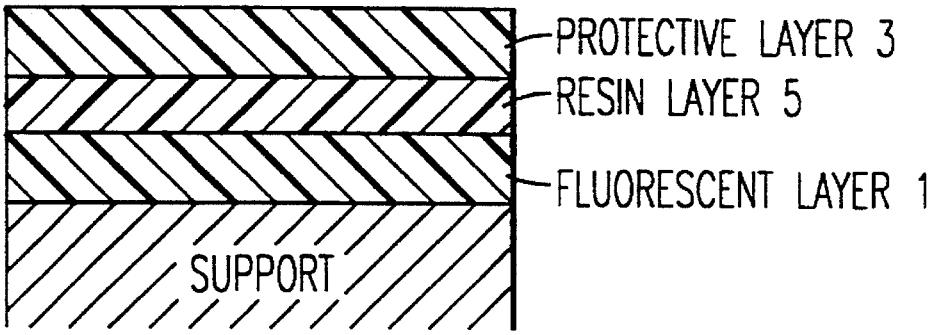
FIG. 3 shows the embodiment wherein a resin layer is present between the fluorescent layer and the protective layer. The fluorescent layer is represented by 1. The resin layer is represented by 5. The protective layer is represented by 3.

With reference to FIGS. 1–3 of the drawing, the radiographic intensifying screen of the present invention is prepared (i) with reference to FIG. 1, by coating a solution containing a phosphor and a binder resin (hereinafter referred to simply as a "phosphor coating solution") on a support, drying to form a fluorescent layer 1, further coating a solution containing a water repellent (hereinafter referred to simply as a "water repellent coating solution") on the fluorescent layer, dryingto form a water repellent layer 2, and further coating a protective layer coating solution thereon to form a protective layer 3, (ii)with reference to FIG. 2, by coating a phosphor coating solution additionally containing a water repellent on a support, drying to form a water repellent containing fluorescent layer 4, and further coating a protective layer coating solution thereon to form a protective layer 3, or (iii) with reference to FIG. 3, by coating a phosphor coating solution on a support, drying to form a fluorescent layer 1, coating a resin solution on the fluorescent phosphor layer, drying to form a resin layer 5, and coating a protective layer coating solution on the resin layer, and drying to form a protective layer 3. Except for the above-mentioned characterizing steps, the intensifying screen of the present invention may be prepared in accordance with a conventional process.

Also, the intensifying screen of the present invention may optionally be prepared by previously forming a fluorescent layer, a water repellent layer or a resin layer and a protective layer on a smooth substrate in this order, peeling the laminated layers from the substrate, and bonding a support to the fluorescent layer side of the laminated layers.

In a general process for preparing an intensifying screen, a fluorescent layer is formed by mixing an appropriate amount of a phosphor with a binder resin such as nitrocellulose, adding an organic solvent thereto to prepare a phosphor coating solution having an appropriate viscosity, coating the phosphor coating solution on a support by a knife coater, a roll coater or the like, and then drying. A binder resin amount remaining in a fluorescent layer is preferably from 1 to 10 parts by weight, more preferably from 1 to 6 parts by weight, per 100 parts by weight of a phosphor, in order to provide a satisfactory photographic sharpness.

Depending on use, a light-reflecting layer, a light-absorbing layer or a metal foil layer may be provided between a fluorescent layer and a support. In such a case, a light-reflecting layer, a light-absorbing layer or a metal foil layer is previously provided on a support, and the above-mentioned phosphor coating solution is coated thereon and dried to form a fluorescent layer.

Examples of a support used in the intensifying screen of the present invention include film-like molded products of polyesters such as cellulose acetate, cellulose propionate, cellulose acetate-butyrate, polyethylene terephthalate or the like, polystyrene, polymethylmethacrylate, polyamide, polyimide, vinyl chloride-vinyl acetate copolymer, polycarbonate or the like; bulk board paper, resin coat paper, ordinary paper, aluminum alloy foil and the like. When the above-mentioned plastic films or papers are used as a support for the intensifying screen of the present invention, a light-absorbing material such as carbon black or a light-reflecting material such as titanium dioxide, calcium carbonate or the like may previously be kneaded into them.

In addition to nitrocellulose, many materials conventionally known as a binder for an intensifying screen may be used as a binder resin, examples of which include cellulose acetate, ethyl cellulose, polyvinyl butyral, linear polyester, polyvinylacetate, vinylidene chloride-vinyl chloride copolymer, vinyl chloride-vinyl acetate copolymer, polyalkyl(meth)acrylate, polycarbonate, polyurethane, cellulose acetate-butyrate, polyvinyl alcohol, gelatin, polysaccharide such as dextrin, gum arabic and the like.

Examples of an organic solvent used for preparing for a phosphor coating solution include ethanol, methylethylether, butyl acetate, ethyl ether, xylene and the like. If necessary, the phosphor coating solution may further contain a dispersant such as phthalic acid, stearic acid or the like, and a plasticizer such as triphenyl phosphate, diethyl phthalate or the like.

There is no particular restriction as to the X-ray phosphor to be used for the intensifying screen of the present invention, and any conventional phosphor may be used which is capable of emitting a light of a high luminance when excited by X-ray radiation, examples of which include $Gd_2O_2S$:Tb, $Y_2O_2S$:Tb, $(Gd,Y)_2O_2S$:Tb, $(Gd,Y)_2O_2S$:Tb:Tm, $La_2O_2S$:Tb, $CaWO_4$, $CdWO_4$, $BaSO_4$:Pb, ZnS:Ag, BaFCl:Eu, LaOBr:Tm, LaOBr:Tb, $GdTaO_4$:Tb, $Gd_2O_3.Ta_2O_5.B_2O_3$:Tb, $YTaO_4$, $YTaO_4$:Tm, $YTaO_4$:Nb, $HfO_2$:Ti, $HfP_2O_7$:Cu, and the like.

In the intensifying screen of the present invention, a phosphor coated amount in the fluorescent layer (dry weight of phosphor per unit area after coating and drying) is preferably from 30 to 200 mg/cm$^2$ for maintaining practically satisfactory photographic sensitivity and sharpness. If the phosphor coated amount is lower than 30 mg/cm$^2$, the sensitivity is lowered. On the other hand, if the phosphor coated amount is higher than 200 mg/cm$^2$, the sensitivity is saturated and is not improved any further, and the sharpness tends to be lowered.

As mentioned above, in the present invention, a fluorescent layer is modified (a) by coating water repellent coating solution on a fluorescent layer and drying to form a water repellent layer on the fluorescent layer, (b) by coating a water repellent coating solution on a fluorescent layer formed in the same manner as above, penetrating at least a part of the water repellent coating solution into the fluorescent layer and drying to modify the fluorescent layer itself or its surface, or (c) by adding a water repellent to a phosphor coating solution, coating the water repellent-containing phosphor coating solution on a support and drying to modify the fluorescent layer itself or its surface. When a protective layer is uniformly formed on the surface of the above prepared water repellent layer or modified fluorescent layer, it is preferable that the surface has a satisfactory water-repelling effect. In order to achieve the satisfactory water-repelling effect by a relatively small amount of a water repellent, it is preferable to form a water repellent layer by coating a water repellent coating solution on a fluorescent layer. When a fluorescent layer itself or its surface is modified by adding a water repellent to a phosphor coating solution, coating the water repellent-containing phosphor coating solution on a support and drying, it is preferable to prepare the water repellent-containing phosphor coating solution at a viscosity lower than usual, thereby settling the phosphor to the support side when coating the water repellent-containing phosphor coating solution on the support. In this manner, the phosphor is distributed relatively at a high concentration on the support side and is distributed relatively at a low concentration on the surface side (protective layer side). Thus, when drying, the water repellent is distributed relatively at a low concentration on the support side and relatively at a high concentration on the surface side (protective layer side) so that the proportion of the water repellent in the fluorescent layer near the interface to the protective layer is higher than the proportion of the water repellent in the fluorescent layer near the interface to the support. Also, when the water repellent coating solution is penetrated into the fluorescent layer by coating the water repellent coating solution on the fluorescent layer, it is preferable to distribute the water repellent at such a concentration gradient as that the proportion of the water repellent in the fluorescent layer near the interface to the protective layer is higher than the proportion of the water repellent in the fluorescent layer near the interface to the support.

When a phosphor coating solution contains a water repellent, the amount of the water repellent contained is preferably from 0.1 to 10% by weight to the weight of the phosphor.

Any water repellent which is transparent and can greatly enlarge a contact angle on the surface of the fluorescent layer, can be used as a water repellent in the present invention, examples of which include silicone type compounds such as silane oligomer, silane monomer, acrylic silicone and the like. Preferable water repellent is an organic silicon compound, and a more preferable water repellent is an alkylalkoxysilane compound.

Thereafter, a protective layer is provided on the above prepared water repellent layer or fluorescent layer modified with a water repellent. A protective layer coating solution having an appropriate viscosity is prepared by adding an organic solvent to a protective layer-forming resin such as cellulose acetate, and the coating solution thus prepared is coated by a knife coater, a roll coater or the like on the water repellent layer or the fluorescent layer modified with a water repellent and dried to form a protective layer. The thickness of the protective layer thus provided should preferably be thinner in view of sharpness and should preferably be thicker in view of physical durability. Thus, a preferable thickness of the protective layer ranges from 2 to 10 μm.

Any resin which can provide a protective layer can be used as a protective layer-forming resin in the present invention, examples of which include cellulose derivatives such as cellulose acetate, nitrocellulose and cellulose acetate-butyrate, vinyl type resins such as polyvinyl chloride, polyvinyl acetate and vinyl chloride-vinyl acetate copolymer, fluorine type resins such as fluoroester, polycarbonate, polyvinyl butyral, polymethylmethacrylate, polyvinylformal, polyurethane and the like.

When coating a protective layer, if the amount of the previously coated water repellent is excessive, the water repellent sometimes oozed into the protective layer or its surface, but the oozed water repellent does not have a bad influence on the intensifying screen properties and rather improves the antifouling properties of the surface of the intensifying screen.

As mentioned above, the intensifying screen of the present invention may be provided with a resin layer formed by coating a resin solution containing a resin and an organic solvent on the fluorescent layer in place of a water repellent coating solution. If the resin layer thus formed is thinner than about 0.3 μm after drying, the resin layer can not satisfactorily achieve the expected effects of preventing the penetration of a protective layer coating solution into a fluorescent layer when coating and of preventing the generation of bubbles. On the other hand, if the resin layer is thicker than about 2.0 m after drying, sharpness of the intensifying screen thus obtained becomes lowered. Thus, the resin solution to form a resin layer is coated in such a manner as to make the resin layer thinner than the protective layer and to make the thickness of the resin layer from 0.3 μm to 2.0 μm.

A resin used for forming the resin layer may be similar to those used as the above mentioned binder resins, but a resin, an organic solvent, a viscosity and the like used for forming the resin layer are optionally selected by considering an organic solvent, a viscosity and the like used for forming the protective layer on the resin layer. Thus, a proportion of a low boiling point solvent in the resin layer coating solution may be made larger, or the coated amount of the resin layer coating solution may be made smaller to reduce time taken from coating to drying, or the viscosity of the resin layer coating solution may be made higher than that of the protective layer coating solution. In this manner, the void space of the porous fluorescent layer surface is filled with the coated resin, thereby preventing the penetration of the protective layer coating solution into the fluorescent layer. Furthermore, a two-pack type resin which is hardly soluble in an organic solvent used in the protective layer coating solution, may be used for more effectively preventing the penetration of the protective layer coating solution into the fluorescent layer or preventing the generation of bubbles.

In the intensifying screen of the present invention having a resin layer between a fluorescent layer and a protective layer, it is preferable to add the above-mentioned water repellent to the resin layer coating solution for more effectively preventing the penetration of the protective layer coating solution into the fluorescent layer and preventing the generation of bubbles.

In such a case, the amount of the water repellent contained in the rein layer is preferably from 5 to 200% by weight to the resin solid content.

Finally, in the above-mentioned manner, a protective layer is formed on the thin layer of the resin layer formed on the surface of the fluorescent layer to provide the intensifying screen of the present invention.

DETAILED DESCRIPTION OF THE PREFERRED EMBODIMENTS

Now, The present invention will be described in further detail with reference to Examples. However, it should be understood that the present invention is by no means restricted by such specific Examples.

EXAMPLE 1

A phosphor coating solution was prepared by mixing 100 parts by weight of $Gd_2O_2S$:Tb phosphor with 5 parts by weight of nitrocellulose (binder resin) and an organic solvent. The phosphor coating solution thus prepared was uniformly coated by a knife coater on a polyethylene terephthalate support having a titanium oxide light-reflecting layer on its surface so as to provide a phosphor coated amount of 60 mg/cm$^2$ (after drying), and was dried. Thereafter, a water repellent coating solution comprising an alkylalkoxysilane solution ("Nittoseal" manufactured by Dai Nippon Toryo K.K.) and an organic solvent was uniformly coated thereon by a knife coater so as to provide a water repellent coated amount 0.03 mg/cm$^2$ (after drying), and was dried. Then, on the surface of the water repellent layer, was uniformly coated a protective layer coating solution obtained by dissolving cellulose acetate in a solvent, and was dried to provide a transparent protective layer having a thickness of about 6 μm, thus obtaining a radiographic intensifying screen (1).

EXAMPLE 2

A phosphor coating solution containing a water repellent was prepared by mixing 100 parts by weight of $Gd_2O_2S$:Tb phosphor with 5 parts by weight of nitrocellulose (binder resin), 10 parts by weight of an alkylalkoxysilane solution (10% by weight solution) ("Nittoseal" manufactured by Dai Nippon Toryo K.K.) and an organic solvent. The water repellent-containing phosphor coating solution thus prepared was uniformly coated by a knife coater on a polyethylene terephthalate support having a titanium oxide light-reflecting layer on its surface so as to provide a phosphor coated amount of 60 mg/cm$^2$ (after drying), and was dried to form a fluorescent layer modified with the water repellent. Thereafter, on the surface of the fluorescent layer modified with the water repellent, was uniformly coated a protective layer coating solution obtained by dissolving cellulose acetate in a solvent and dried to form a transparent protective layer having a thickness of about 6 μm, thus obtaining a radiographic intensifying screen (2).

COMPARATIVE EXAMPLE 1

A comparative radiographic intensifying screen (R1) was prepared in the same manner as in Example 1, except that the water repellent coating solution was not coated.

COMPARATIVE EXAMPLE 2

A comparative radiographic intensifying screen (R2) was prepared in the same manner as in Example 2, except that the water repellent-containing phosphor coating solution was replaced by a phosphor coating solution prepared by mixing 100 parts by weight of $Gd_2O_2S$:Tb phosphor with 15 parts by weight of nitrocellulose (binder resin) and an organic solvent, which did not contain a water repellent.

Each of the above prepared radiographic intensifying screens was tested with regard to relative sharpness and antifouling properties, and the test results are shown in Table 1, together with the data concerning thickness of a protective layer, presence or absence of a water repellent, and binder/phosphor weight ratio in a fluorescent layer. The thickness of a protective layer was determined by checking the section of a radiographic intensifying screen by a scanning electron microscope. The antifouling property was evaluated by fouling the surface of a protective layer with a wax pencil (dark blue color "Darmatograph" manufactured by Mitsubishi Enpitsu K.K.) and checking easiness when wiping the foul off with gauze impregnated with ethyl alcohol. The relative sharpness was measured by comparing MTF values at 2 lines/mm of spatial frequency.

phor layer. On the other hand, the radiographic intensifying screens (1) and (2) of Examples 1 and 2 prepared by using a water repellent, the antifouling properties were excellent since protective layers of satisfactory thickness were formed as the protective layer coating solutions did not substantially penetrate into the fluorescent phosphor layers. Thus, in the radiographic intensifying screens (1) and (2) of Examples 1 and 2, the protective layers satisfactorily achieved their functions.

On the other hand, in the radiographic intensifying screen (R2) of Comparative Example 2, a sufficient protective layer could be formed since the protective layer coating solution did not penetrate into the fluorescent layer as the void space in the fluorescent layer was filled with the binder resin by increasing the binder resin amount in the phosphor coating solution. However, the relative sharpness of the comparative radiographic intensifying screen (R2) became very poor as compared with those of the radiographic intensifying screens (1) and (2) of Examples 1 and 2 since the binder resin amount in the fluorescent layer was increased.

EXAMPLE 3

A phosphor coating solution was prepared by mixing 100 parts by weight of $Gd_2O_2S$:Tb phosphor with 5 parts by weight of nitrocellulose (binder resin) and an organic solvent. The phosphor coating-solution thus prepared was uniformly coated by a knife coater on a polyethylene terephthalate support having a titanium oxide light-reflecting layer on its surface, and dried to obtain a fluorescent layer having a phosphor coated amount of 60 mg/cm$^2$. On the fluorescent layer thus obtained, was uniformly coated a resin solution comprising nitrocellulose, acetone and butyl acetate by a knife coater, and dried to form a resin layer having a thickness of 1.1 μm. Thereafter, on the surface of the resin layer thus obtained, was uniformly coated a protective layer coating solution obtained by dissolving cellulose acetate in a mixture solution of acetone and butyl acetate, and dried to provide transparent protective layer having a thickness of about 6 μm, thus obtaining a radiographic intensifying screen (3).

EXAMPLE 4

A radiographic intensifying screen (4) was prepared in the same manner as in Example 3, except that a fluorescent layer was formed by using a phosphor coating solution obtained

| | Treatment by water repellent | Binder weight/ Phosphor weight | Thickness of protective layer after drying (μm) | Antifouling property | Sharpness (%) |
|---|---|---|---|---|---|
| Example 1 Intensifying screen (1) | Treated | 5/100 | 6.0 | Good | 120 |
| Example 2 Intensifying screen (2) | Treated | 5/100 | 6.0 | Good | 118 |
| Comparative Example 1 Intensifying screen (R1) | Not treated | 5/100 | 0.5 | No good | 128 |
| Comparative Example 2 Intensifying screen (R2) | Not treated | 15/100 | 6.0 | Good | 100 |

As evident from Table 1, in the radiographic intensifying screen (R1) of Comparative Example 1, the antifouling property was very poor since a protective layer was not substantially formed after drying as most of the protective layer coating solution penetrated into the fluorescent phosby mixing 100 parts by weight of $Sd_2O_2S$:Tb phosphor with 3 parts by weight of nitrocellulose (binder resin) and an organic solvent and a resin layer was formed by using a resin solution obtained by incorporating 50 parts by weight of an alkylalkoxysilane ("Nittoseal" manufactured by Dai Nippon Toryo K.K.) as a water repellent per 100 parts by weight of nitrocellulose into a resin solution containing nitrocellulose.

COMPARATIVE EXAMPLE 3

A comparative radiographic intensifying screen (R3) was prepared in the same manner as in Example 3, except that the resin layer was not formed on the fluorescent layer.

COMPARATIVE EXAMPLE 4

A comparative radiographic intensifying screen (R4) was prepared in the same manner as in Comparative Example 3, except that a phosphor coating solution obtained by mixing 100 parts by weight of $Gd_2O_2S$:Tb phosphor with 15 parts by weight of nitrocellulose (binder resin) and an organic solvent was used.

Each of the above prepared radiographic intensifying screens was tested with regard to sharpness and antifouling properties, and the test results are shown in Table 2, together with the data concerning thickness of a protective layer, thickness of a resin layer and binder/phosphor weight ratio in a fluorescent layer.

| | Presence or absence of resin layer (Thickness of resin layer) | Binder weight/ Phosphor weight | Thickness of protective layer after drying (μm) | Antifouling property | Sharpness (%) |
|---|---|---|---|---|---|
| Example 3 Intensifying screen (3) | Present (1.1 μm) | 5/100 | 6.0 | Good | 120 |
| Example 4 Intensifying screen (4) | Present (1.1 μm) (Water repellent was added) | 3/100 | 6.0 | Good | 128 |
| Comparative Example 3 Intensifying screen (R3) | Absent | 5/100 | 0.5 | No good | 128 |
| Comparative Example 4 Intensifying screen (R4) | Absent | 15/100 | 6.0 | Good | 100 |

AS evident from Table 2, in the radiographic intensifying screen (R3) of Comparative Example 3, the antifouling property was very poor since a protective layer was not substantially formed after drying as most of the protective layer coating solution penetrated into the fluorescent layer. On the other hand, in the radiographic intensifying screen (3) of Example 3 having a resin layer between a fluorescent layer and a protective layer, the antifouling property was excellent since a protective layer of sufficient thickness was formed as the protective layer coating solution did not substantially penetrate into the fluorescent layer.

Furthermore, in the radiographic intensifying screen (4) of Example 4 having a resin layer containing an alkylalkoxysilane as a water repellent, the sharpness was greatly improved and the antifouling property was also good since a protective layer of sufficient thickness was formed as the protective layer coating solution did not substantially penetrate into the fluorescent layer although the binder/phosphor weight ratio was lowered to 3/100.

On the other hand, in the radiographic intensifying screen (R4) of Comparative Example 4, the binder resin amount in the fluorescent layer was large enough to fill the void space in the fluorescent layer, and accordingly the protective layer coating solution did not penetrate into the fluorescent layer, thus forming a sufficient protective layer. However, since the binder resin amount in the fluorescent layer was excessive, the sharpness of the comparative radiographic intensifying screen (R4) was very poor as compared with that of the radiographic intensifying screen (3) of Example 3.

As mentioned above, as compared with a conventional radiographic intensifying screen having a protective layer formed with a protective layer coating solution, the radiographic intensifying screen of the present invention provides remarkably improved sharpness and durability since a satisfactory uniform protective layer can be formed although the content of the binder resin in the fluorescent layer is lowered.

What is claimed is:

1. A radiographic intensifying screen which comprises a support, a fluorescent layer formed on the support, a water repellent layer provided on the fluorescent layer and a protective layer formed by coating a solution containing a protective layer-forming resin on the water repellent layer.

2. The radiographic intensifying screen according to claim 1, wherein the fluorescent layer contains a binder in an amount of 1 to 10 parts by weight per 100 parts by weight of a phosphor.

3. The radiographic intensifying screen according to claim 1, wherein the water repellent is an organic silicon compound.

4. The radiographic intensifying screen according to claim 3, wherein the organic silicon compound is an alkylalkoxysilane.

5. A radiographic intensifying screen which comprises a support, a fluorescent layer formed on the support, and a protective layer formed by coating a solution containing a protective layer-forming resin on the fluorescent layer, wherein the fluorescent layer contains a water repellent, and wherein the water repellent is distributed so that the proportion of the water repellent in the fluorescent layer near the interface to the protective layer is higher than the proportion of the water repellent in the fluorescent layer near the interface to the support.

6. The radiographic intensifying screen according to claim 5, wherein the fluorescent layer contains a binder in an amount of 1 to 10 parts by weight per 100 parts by weight of a phosphor.

7. The radiographic intensifying screen according to claim 5, wherein the water repellent is an organic silicon compound.

8. The radiographic intensifying screen according to claim 7, wherein the organic silicon compound is an alkylalkoxysilane.

9. A radiographic intensifying screen which comprises a support, a fluorescent layer formed on the support, a resin layer provided by coating a resin solution on the fluorescent layer, and a protective layer formed by coating a solution containing a protective layer-forming resin on the resin layer, and wherein the resin layer contains a water repellent.

10. The radiographic intensifying screen according to claim 9, wherein the fluorescent layer contains a binder in an amount of 1 to 10 parts by weight per 100 parts by weight of a phosphor.

11. The radiographic intensifying screen according to claim 9, wherein the resin layer is thinner than the protective layer and has a thickness of from 0.3 μm to 2.0 μm.

12. The radiographic intensifying screen according to claim 9, wherein the water repellent is an organic silicon compound.

13. The radiographic intensifying screen according to claim 12, wherein the organic silicon compound is an alkylalkoxysilane.

14. A process for preparing a radiographic intensifying screen, which comprises coating a solution containing a water repellent on a fluorescent layer previously formed, drying, further coating a solution containing a protective layer-forming resin thereon, and drying.

15. A process for preparing a radiographic intensifying screen, which comprises coating a phosphor solution containing a water repellent on a support to form a fluorescent layer thereon, drying, further coating a solution containing a protective layer-forming resin thereon, and drying, wherein the water repellent is distributed so that the proportion of the water repellent in the fluorescent layer near the interface to the protective layer is higher than the proportion of the water repellent in the fluorescent layer near the interface to the support.

16. A process for preparing a radiographic intensifying screen, which comprises coating a resin solution containing a resin, a water repellent and an organic solvent on a fluorescent layer previously formed, drying to form a resin layer, further coating a solution containing a protective layer-forming resin thereon, and drying to form a protective layer.

17. The process according to claim 16, wherein the resin solution and the solution containing the protective layer-forming resin are respectively coated in such amounts as to make the resin layer thinner than the protective layer and to make the thickness of the resin layer from 0.3 μm to 2.0 μm.

18. The process according to claim 16, wherein the resin of the resin layer is not dissolved in the solution containing the protective layer-forming resin.

19. The process according to claim 16, wherein the viscosity of the resin solution is higher than the viscosity of the solution containing the protective layer-forming resin.

* * * * *